US005780774A

United States Patent [19]

Ichikawa et al.

[11] Patent Number: 5,780,774

[45] Date of Patent: Jul. 14, 1998

[54] CONNECTION STRUCTURE OF ELECTRIC WIRE AND FLAT CABLE

[75] Inventors: Hidehiro Ichikawa; Satoshi Ishikawa, both of Shizuoka-ken, Japan

[73] Assignee: Yazaki Corporation, Tokyo, Japan

[21] Appl. No.: 654,881

[22] Filed: May 29, 1996

[30] Foreign Application Priority Data

May 30, 1995 [JP] Japan ..... 7-131886

[51] Int. Cl.[6] ..... H01R 9/07

[52] U.S. Cl. ..... 174/88 R; 174/117 FF; 439/499

[58] Field of Search ..... 174/84 R, 88 R, 174/117 F, 117 FF; 439/492, 493, 499

[56] References Cited

U.S. PATENT DOCUMENTS

| | | | |
|---|---|---|---|
| 4,413,028 | 11/1983 | Diaz | 174/84 R |
| 4,952,256 | 8/1990 | Schauer et al. | 156/49 |
| 5,045,641 | 9/1991 | Urushibata et al. | 174/88 R |
| 5,231,758 | 8/1993 | Schauer et al. | 29/856 |
| 5,481,069 | 1/1996 | Andresen et al. | 174/117 F |
| 5,606,150 | 2/1997 | Radliff et al. | 174/92 |

FOREIGN PATENT DOCUMENTS

| | | |
|---|---|---|
| 0 542 005 A1 | 10/1992 | Germany . |
| 64-21988 | 2/1989 | Japan . |

*Primary Examiner*—Kristine L. Kincaid
*Assistant Examiner*—Marc Machtinger
*Attorney, Agent, or Firm*—Finnegan, Henderson, Farabow, Garrett & Dunner, L.L.P.

[57] ABSTRACT

Exposed forward ends of conductors of the electric wire and the flat cable are connected to each other. The conductors of the electric wire set to a length adapted for being overlaid on the conductors of the flat cable are held in overlaid relation with the conductors of the flat cable between insulating partitioning walls formed on the upper surface of a holder for isolating each adjacent pair of the conductors of the electric wire. The overlaid portions of the conductors are thus connected in the above-mentioned overlaid relation, and are insert-molded including the connected portions, thereby connecting the electric wire and the flat cable directly.

4 Claims, 4 Drawing Sheets

CONNECTION STRUCTURE OF ELECTRIC WIRE AND FLAT CABLE

BACKGROUND OF THE INVENTION

The present invention relates to a connection structure of an electric wire and a flat cable used with, for example, an electrical connector for transmitting and receiving electrical signals between the steering wheel shaft and the housing fixed on the steering column of the steering mechanism of an automotive vehicle.

The steering mechanism of the automotive vehicle has such a connection structure that a spiral flexible flat cable (FFC) is mounted on the steering wheel shaft and is connected to the lead wire of the housing fixed on the steering column thereby to absorb the rotations of the steering wheel shaft.

The lead wire having a comparatively wide pitch between the conductors thereof exposed to the ends is difficult to connect directly to the FFC having a small pitch between the conductors thereof exposed to the ends due to the short conductor portion of the lead wire exposed to the ends thereof and the resulting interference between the insulating coverings of the lead wire.

For this reason, the lead wire and the FFC of different pitches are conventionally connected through a bus bar, for example.

This connection structure is configured in such a manner that the conductors exposed to the ends of the lead wire and the FFC are connected first with the ends of the bus bar arranged on the upper surface of the assembly, followed by the insert molding for covering the assembly including the connected portions with a synthetic resin material.

The connection structure configured this way can protect the junction of the conductors by the synthetic resin covered by insert molding and at the same time can secure the tensile strength of both the lead wire and the FFC.

A structure analogous to the above-mentioned structure is disclosed in Japanese Utility-Model Laid-Open No.64-21988, etc.

The conventional connection structure described above, which uses a bus bar having a weld zone at the ends thereof, poses the problem of many component parts required, a long time taken for welding work and the resulting higher manufacturing cost.

SUMMARY OF THE INVENTION

The object of the present invention, which has been developed in order to solve the above-mentioned problems, is to provide a connection structure capable of connecting an electric wire and a flat cable of different pitches in stable fashion without using a bus bar.

In order to achieve the above-mentioned object, according to the invention, there is provided a structure for connecting exposed ends of the conductors of an electric wire and a flat cable to each other, wherein the conductors of the electric wire set to a length adapted for being overlaid on the conductors of the flat cable are overlaid and held on the conductors of the flat cable between the insulating partitioning walls formed on the upper surface of a holder for isolating each pair of adjacent conductors of the electric wire, so that the overlaid portions of the conductors of the electric wire and the flat cable are connected to each other while being securely held, with the connected portions being insert-molded.

As mentioned above, the electric wire and the flat cable are held by a holder with the conductors of the flat cable overlaid on the conductors of the electric wire set to a length adapted for being overlaid on the conductors of the flat cable. As a result, the conductors can be connected directly without regard to the thickness of the insulating coverings of the electric wire and the flat cable, and the need of a bus bar, for example, is eliminated. The number of component parts required and the welding points thus can be reduced for an improved workability.

Also, in view of the fact that an insulating partitioning wall is formed on the uppermost surface of the holder for isolating each pair of adjacent conductors of the electric wire, the conductors can be placed in position while at the same time keeping the adjacent conductors out of contact with each other.

Further, the conductors can be insert-molded integrally after being connected, and therefore a superior insulation and a high connection strength can be obtained between the connected portions and the conductors of the electric wire.

Furthermore, the holder may have a fixing wall extending and rising along the width at the opposite end thereof, in which the insulating covering of the electric wire is inserted and held securely.

In this way, the electric wire can be easily and stably fixed on the holder and thereby the workability of welding work can be improved.

What is more, a recess adapted to engage the insulating covering of the flat cable may be formed at an end of the holder.

The flat cable thus can be fixed easily and in stable fashion on the holder, thereby improving the welding workability.

DESCRIPTION OF THE PREFERRED EMBODIMENTS

The present invention will be described below specifically with reference to the embodiment shown in the accompanying drawings. FIGS. 1 to 6 show a connection structure of an electric wire and a flat cable according to an embodiment.

This connection structure is used for the steering mechanism of the automotive vehicle, for example. This steering mechanism has a connection structure in which a spiral flexible flat cable (FFC) arranged on the steering wheel shaft is connected with a lead wire of the housing fixed on the steering column in such a manner as to absorb the rotation of the steering wheel shaft.

In the connection structure between a lead wired 1 as an electric wire and a FFC 2, conductors 1*a* of the lead wire 1 having a comparatively wide pitch and conductors 2*a* of the FFC 2 having a comparatively small pitch are connected to each other on the upper surface of a holder 4 formed by a synthetic resin material, and are subjected to the insert molding including the connected portions.

Figure 1:
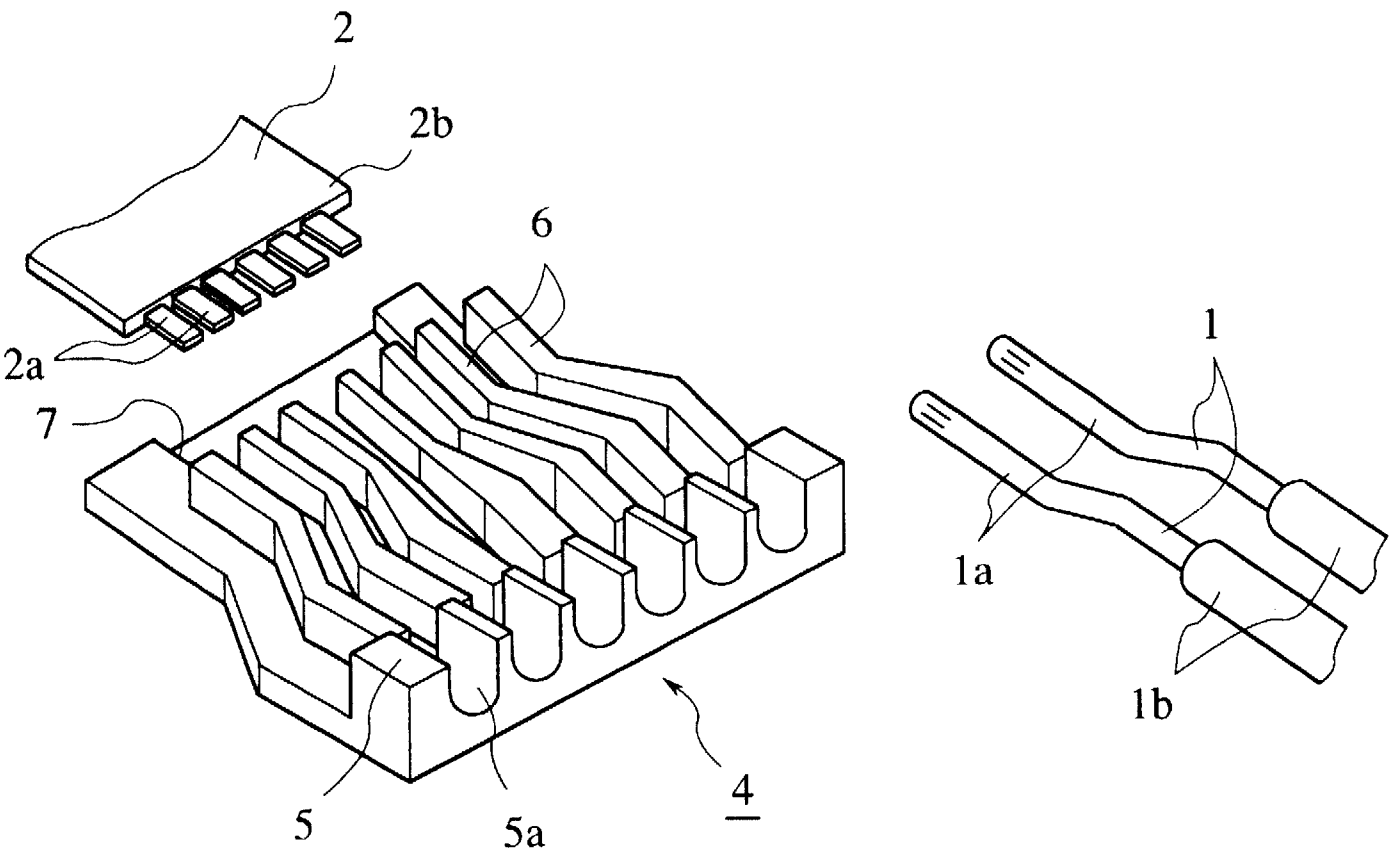
FIG. 1 is an exploded perspective view according to an embodiment of the invention.
Figure 2:
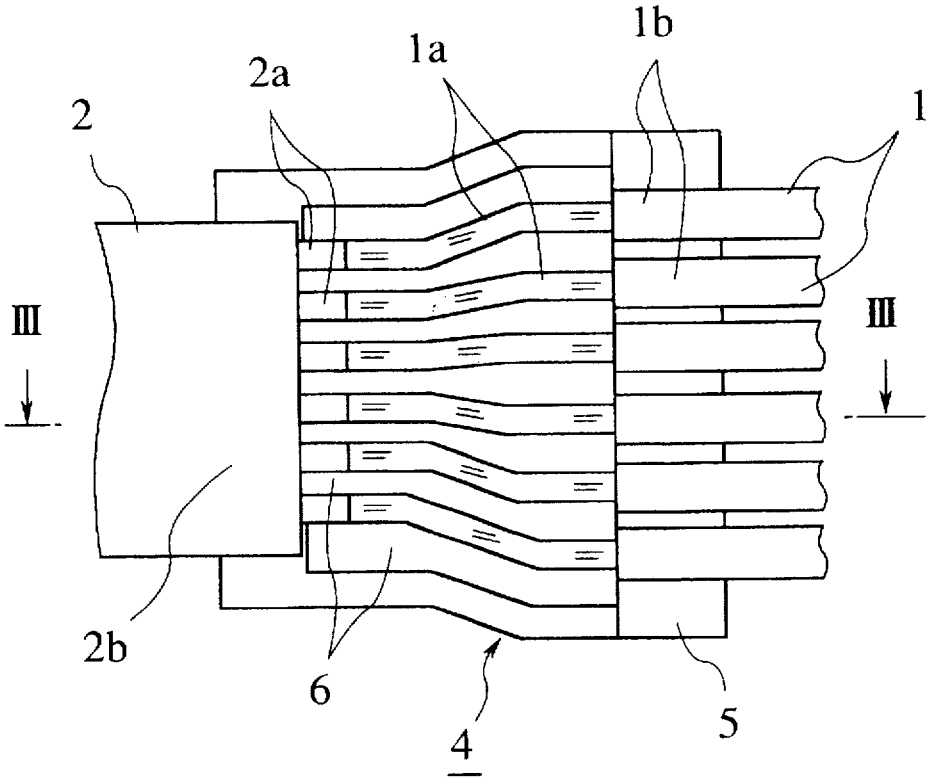
FIG. 2 is a plan view showing the lead wire and the flat cable assembled before the welding work according to the same embodiment.

The holder 4 has along the width of an end thereof a fixing wall 5 formed in protrusion and extending along the width, which fixing wall includes a plurality of holding grooves 5*a* for holding the insulating coverings 1*b* of the lead wire 1 inserted therein. A plurality of insulating partitioning walls 6 each having a length substantially equal to the length of the holder 4 are formed in protrusion extending to the other end of the holder 4 from the holding groove 5*a*. The insulating partitioning walls 6 thus set the conductors 1*a* of the lead wire 1 in position, while at the same time keeping adjacent ones of the conductors 1*a* out of contact with each other. The conductors 1*a* of the lead wire 1 are set longer than in the prior art in such a manner as to be overlaid on the conductors 2*a* of the FFC 2 held at the other end of the holder 4 (FIGS. 1 and 2).

Figure 5:
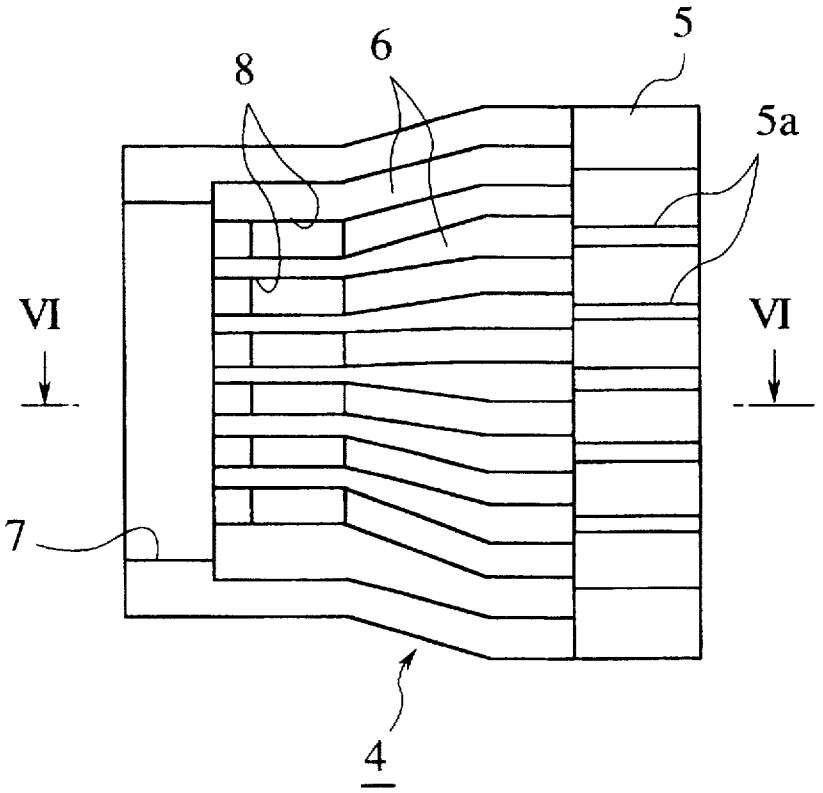
FIG. 5 is a plan view showing a holder according to the same embodiment.
Figure 6:
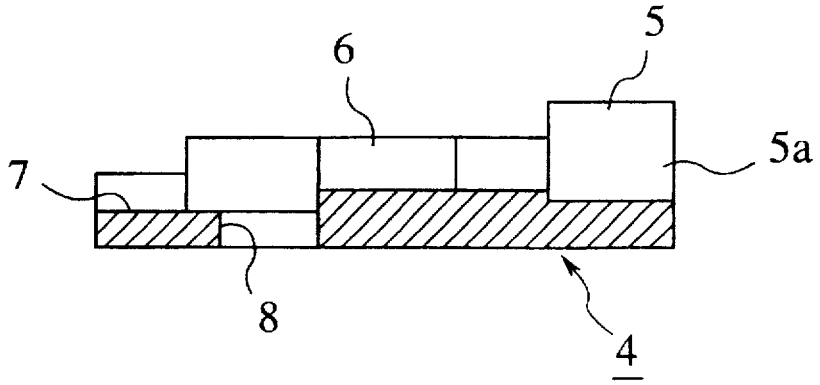
FIG. 6 is a sectional view taken in line VI—VI in FIG. 5.

The other end of the upper surface of the holder 4, on the other hand, has a protrusion 7 formed at the ends thereof extending upward to engage the sides of the insulating covering 2*b* of the FFC 2. The conductors 2*a* of the FFC 2 fixed to this protrusion 7 are overlaid by the forward ends of the conductors 1*a* of the lead wire 1. Also, the lower surface of the holder 4 has a plurality of welding holes 8 formed to extend to the conductors 2*a* of the FFC 2 arranged on the upper surface of the holder 4, thereby facilitating the welding work between the conductors 1*a*, 2*a* of the lead wire 1 and the FFC 2 (FIGS. 5 and 6).

Figure 3:
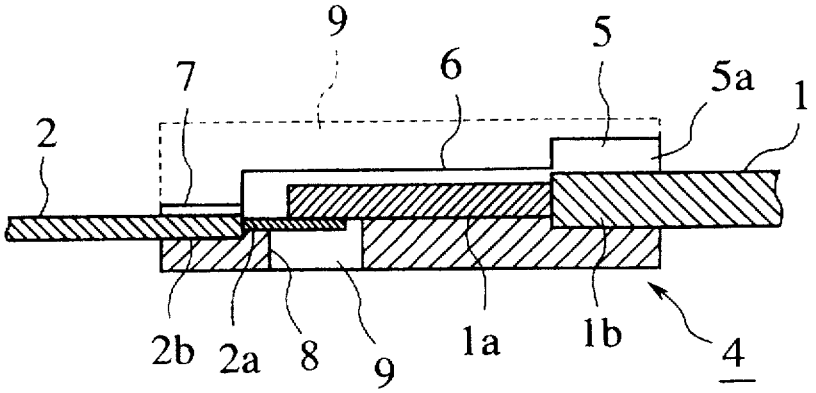
FIG. 3 is a sectional view taken in line III—III in FIG. 2.
Figure 4:
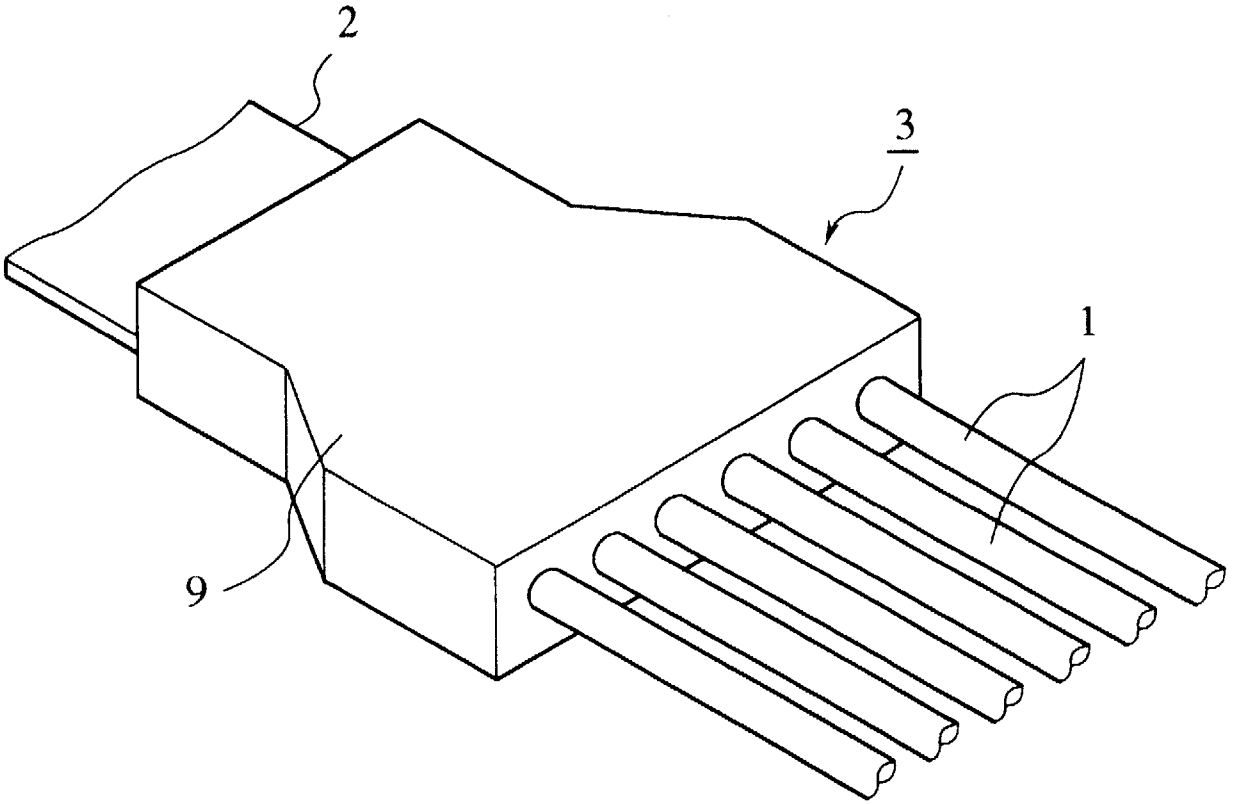
FIG. 4 is a perspective view showing a connection structure with the electric wire and the flat cable subjected to insert molding according to the same embodiment.

In the connection under consideration, the insulating covering 2*b* of the FFC 2 is engaged with the protrusions 7, and the conductors 1 of the lead wire 1 are pressed in, slightly twisted, collectively between the insulating partitioning walls 6 using a pressure jig or the like. After the conductors 1*a*, 2*a* of the lead wire 1 and the FFC 2 are welded to each other, the assembly including the welded parts are insert-molded in such a manner as to be covered with the synthetic resin material 9 (FIGS. 3 and 4). Any of the well-known welding processes including ultrasonic welding and spot welding may be used appropriately for this welding work.

In short, according to the embodiment described above, a bus bar 13 is not used for connecting the lead wire 1 and the FFC 2. Therefore, the number of component parts and welding points can be reduced, resulting in an improved workability and an improved manufacturing cost.

Also, since the whole assembly including the welded portions are insert-molded after performing the welding work on the conductors 1*a* and 2*b*, the covering of the synthetic resin material 9 protects the welded portions of the conductors 1*a*, 2*a* of the lead wire 1 and the flat cable 2, while at the same securing the strength against the axial load of the lead wire 1 and the FFC 2.

Further, in view of the fact that the holding grooves 5*a* for fixedly holding the lead wire 1, the insulating partitioning walls 6 for fixedly positioning the conductors 1*a* of the lead wire 1 and the protrusions 7 for fixing the FFC 2 are formed on the upper surface of the holder 4, the conductors 1*a*, 2*a* of the lead wire 1 and the FFC 2 can be fixed stably and easily on the upper surface of the holder 4 while the lead wire 1 and the FFC 2 are welded to each other.

Although the embodiment described above refers to the case in which the conductors 1*a* of the lead wire 1 have a length substantially equal to the length of the holder 4, the invention is not confined to such a case but of course is applicable with equal effect to the case in which each conductor 1*a* of the lead wire 1 has a length substantially equal to the length of the conductors 11*a* of the lead wire 11 in the prior art.

What is claimed is:

1. A connection structure between an electric wire and a flat cable for connecting exposed forward ends of conductors of the electric wire and the conductors of a flat cable to each other, wherein:

the conductors of the electric wire, set to a length adapted for being overlaid on the conductors of the flat cable, are held in an overlaid relation with the conductors of the flat cable between insulating partitioning walls formed on an upper surface of a holder for isolating pairs of adjacent conductors of the electric wire, and overlaid portions of the conductors of the electric wire and the flat cable are connected and held in said overlaid relation and insert-molded.

2. A connection structure between an electric wire and a flat cable according to claim 1, further comprising:

a fixing wall extending from the upper surface of the holder along a width of an end of the holder and having a greater height than the insulating partitioning walls, said fixing wall having a plurality of holding grooves formed therein in which insulating coverings of the electric wire are inserted and held.

3. A connection structure between an electric wire and a flat cable according to claim 2, wherein at least a protrusion for engaging an insulating covering of the flat cable is formed at an end of the holder.

4. A connection structure between an electric wire and a flat cable according to claim 1, wherein at least a protrusion for engaging an insulating covering of the flat cable is formed at a second end of the holder.

* * * * *